US006991123B2

(12) United States Patent
Druitt et al.

(10) Patent No.: US 6,991,123 B2
(45) Date of Patent: Jan. 31, 2006

(54) CLOSURE WITH EXTENDED SEAL MEMBER

(75) Inventors: Rodney Malcolm Druitt, Cirencester (GB); Michael Patrick Furlong, Tialpan (MX)

(73) Assignee: Closures and Packaging Services Limited, Guernsey (GB)

( * ) Notice: Subject to any disclaimer, the term of this patent is extended or adjusted under 35 U.S.C. 154(b) by 0 days.

(21) Appl. No.: 10/359,064

(22) Filed: Feb. 6, 2003

(65) Prior Publication Data

US 2003/0116523 A1 Jun. 26, 2003

Related U.S. Application Data

(63) Continuation of application No. 09/462,781, filed as application No. PCT/AU98/00510 on Jul. 3, 1998, now Pat. No. 6,527,132.

(30) Foreign Application Priority Data

Jul. 14, 1997 (AU) ..... PO 7885

(51) Int. Cl.
*B65D 53/00* (2006.01)

(52) U.S. Cl. ..... 215/341; 215/343; 215/344; 215/DIG. 1

(58) Field of Classification Search ..... 215/341, 215/343, 344, DIG. 1, 345; 220/304, 795
See application file for complete search history.

(56) References Cited

U.S. PATENT DOCUMENTS

| | | | |
|---|---|---|---|
| 2,162,711 | A | 6/1939 | Hamberger |
| 2,162,712 | A | 6/1939 | Hamberger |
| 2,162,752 | A | 6/1939 | Hamberger |
| 2,162,754 | A | 6/1939 | Schauer |
| 2,367,317 | A | 1/1945 | Thomas |

(Continued)

FOREIGN PATENT DOCUMENTS

| | | |
|---|---|---|
| AR | 231523 | 12/1984 |
| AR | 235977 | 10/1987 |
| AR | 237540 | 9/1988 |
| AR | 237734 | 9/1988 |
| AU | 923966 | 2/1968 |
| AU | 44533/68 | 4/1970 |
| AU | 31986/77 | 6/1979 |
| AU | 45142/79 | 10/1979 |
| AU | 47058/79 | 11/1979 |
| AU | 51954/79 | 5/1980 |

(Continued)

OTHER PUBLICATIONS

Hungarian Search Report.
650 444—93915531.3—Aug. 16, 1999—Crown Cork AG Romerstrasse83 CH–4153 Reinach Switzerland —OPPOSITION.

*Primary Examiner*—Joseph C. Merek
(74) *Attorney, Agent, or Firm*—McDermott Will & Emery LLP

(57) ABSTRACT

A closure (10) having a sealing rib (14) projecting downwardly from the underside of its top portion (11). The first portion (15) of the sealing rib (14) increases in thickness as it extends away from the top portion (11). In another aspect, the invention relates to a closure (10) in which the sealing rib (14) has a third portion (18) that is substantially no thicker than the second portion (17) of the rib (14) and has a length longer, and preferably substantially longer, than its thickness. In the second aspect, the third portion (18) of the rib (14) is connected to the second portion (17) at or adjacent its free edge and extends generally in a direction away from the top portion (11). Upon attachment of the closure (10) with the neck (22) of a container, the third portion (18) will be displaced to lie between the end portion (23) of the neck (22) of the container and the top portion (11) of the closure (10).

23 Claims, 5 Drawing Sheets

U.S. PATENT DOCUMENTS 2,990,077 A 6/1961 Van Baarn
3,032,226 A 5/1962 Terwilliger
3,038,624 A 6/1962 Weickmann
3,053,406 A 9/1962 Wandell
3,055,526 A 9/1962 Plunkett
3,067,900 A 12/1962 Kessler
3,069,040 A 12/1962 Corsette
3,109,547 A 11/1963 Wood
3,141,586 A 7/1964 Wetterek
3,142,402 A 7/1964 Fox
3,145,869 A 8/1964 Ritzenhoff
3,151,757 A 10/1964 Martin
3,200,981 A 8/1965 Harding
3,203,571 A 8/1965 Plunkett
3,224,617 A 12/1965 Hohl et al.
3,255,907 A 6/1966 Eddy
3,259,233 A 7/1966 Beeman
3,286,866 A 11/1966 McIntosh
3,329,295 A 7/1967 Fields
3,335,889 A 8/1967 Brümme
3,393,818 A 7/1968 McIntosh
3,405,830 A 10/1968 Hayashida
3,438,528 A 4/1969 Fields
3,441,161 A 4/1969 Van Baarn et al.
3,455,478 A 7/1969 Fields et al.
3,463,341 A 8/1969 Fields
3,494,496 A 2/1970 Livingstone
3,568,871 A 3/1971 Livingstone
3,583,591 A 6/1971 Hayashida
3,632,005 A 1/1972 Kessler
3,673,761 A 7/1972 Leitz
3,737,064 A 6/1973 Patel et al.
3,750,821 A 8/1973 Sourbet et al.
3,784,041 A 1/1974 Birch
3,802,590 A 4/1974 Culver
3,814,274 A 6/1974 McIntosh
3,851,784 A 12/1974 Gryncewicz
3,854,618 A 12/1974 Beghini
3,865,263 A 2/1975 Birch
3,874,540 A 4/1975 Hidding
3,901,404 A 8/1975 Feldman
3,904,062 A 9/1975 Grussen
3,927,784 A 12/1975 Cochrane
3,930,588 A 1/1976 Coursaut
3,948,405 A 4/1976 Yonker
3,986,627 A 10/1976 Zapp
3,990,598 A 11/1976 Zapp et al.
4,016,996 A 4/1977 Achinger et al.
4,033,472 A 7/1977 Aichinger
4,061,240 A 12/1977 Brownbill
4,069,937 A 1/1978 Smalley
4,089,463 A 5/1978 Babiol
4,090,631 A 5/1978 Grussen
4,109,814 A 8/1978 Rausing
4,109,816 A 8/1978 Faulstich
4,125,201 A 11/1978 Birch
4,126,240 A 11/1978 Brach
4,147,268 A 4/1979 Patel et al.
4,165,813 A 8/1979 Babiol
4,177,906 A 12/1979 Von Hagel
4,196,818 A 4/1980 Brownbill
4,197,955 A 4/1980 Luenser
4,210,251 A 7/1980 Grussen
4,220,250 A 9/1980 Brownbill
4,225,050 A 9/1980 Reinhart
4,241,842 A 12/1980 Toeppen
4,253,581 A 3/1981 Aichinger et al.
4,276,989 A 7/1981 Hicks
4,278,180 A 7/1981 Willie
4,299,328 A 11/1981 Ochs et al.
4,301,937 A 11/1981 Von Hagel
4,305,516 A 12/1981 Perne et al.
4,322,012 A 3/1982 Conti
4,325,487 A 4/1982 Libit
4,343,408 A 8/1982 Csaszar
4,349,116 A 9/1982 Luenser
4,352,436 A 10/1982 Chartier et al.
4,380,299 A 4/1983 Alejandro Llera
4,394,918 A 7/1983 Grussen
4,398,645 A 8/1983 Toeppen
4,416,383 A 11/1983 Frahm et al.
4,432,461 A 2/1984 Mumford et al.
4,436,212 A 3/1984 Alejandro Llero
4,442,947 A 4/1984 Banich, Sr.
4,450,973 A 5/1984 Toeppen
4,459,835 A 7/1984 Hurskainen
4,461,390 A 7/1984 Csaszar
4,461,392 A 7/1984 Conti
4,462,502 A 7/1984 Luenser
4,479,586 A 10/1984 Csaszar
4,503,985 A 3/1985 Swartzbaugh et al.
4,526,282 A 7/1985 Dutt et al.
4,526,284 A 7/1985 Herbert
4,529,096 A 7/1985 Charvier et al.
4,540,102 A 9/1985 Wiedmer
4,552,328 A 11/1985 Dutt et al.
4,557,393 A 12/1985 Boik
4,562,930 A 1/1986 Lecinski, Jr. et al.
4,572,387 A 2/1986 Luker et al.
4,598,835 A 7/1986 Brownbill
4,623,070 A 11/1986 Nishikawa
4,635,808 A 1/1987 Nolan
4,655,356 A 4/1987 Fuchs
4,664,279 A 5/1987 Obrist et al.
4,667,838 A 5/1987 Yeager
4,682,700 A 7/1987 Montgomery et al.
4,708,255 A 11/1987 Thompson
4,726,484 A 2/1988 Lutz
4,739,893 A 4/1988 Zumbuhl
4,768,669 A 9/1988 Zane et al.
4,770,306 A 9/1988 Szczesniak
4,793,506 A 12/1988 Thompson
4,805,792 A 2/1989 Lecinski, Jr.
4,811,857 A 3/1989 Thompson
4,823,967 A 4/1989 Thompson
4,856,668 A 8/1989 Pfefferkorn
4,872,304 A 10/1989 Thompson
4,878,589 A 11/1989 Webster et al.
4,890,754 A 1/1990 Dorn et al.
4,905,852 A 3/1990 Zumbuhl
4,907,709 A 3/1990 Abe et al.
4,913,300 A 4/1990 Wiedmer et al.
4,917,269 A 4/1990 Fuchs et al.
4,997,097 A 3/1991 Krautkrämer
5,004,112 A 4/1991 McBride
5,050,753 A 9/1991 Trump et al.
5,090,788 A 2/1992 Ingram et al.
5,131,550 A 7/1992 Thompson
5,167,335 A 12/1992 McBride et al.
5,197,621 A 3/1993 Bartl et al.
5,215,204 A 6/1993 Beck et al.
5,230,856 A 7/1993 Schellenbach
5,246,125 A 9/1993 Julian
5,320,236 A 6/1994 Gregory
5,423,444 A 6/1995 Druitt
5,609,263 A 3/1997 Perchepied
5,638,972 A 6/1997 Druitt
5,676,269 A 10/1997 Blake et al.
5,782,369 A 7/1998 Tansey
5,791,506 A 8/1998 Sheffler et al.
6,527,132 B1 * 3/2003 Druitt et al. ..... 215/341

FOREIGN PATENT DOCUMENTS

| | | | |
|---|---|---|---|
| AU | 66169/81 | | 8/1981 |
| AU | 67171/81 | | 8/1981 |
| AU | 78506/81 | | 7/1982 |
| AU | 65114/86 | | 8/1983 |
| AU | 14180/83 | | 11/1983 |
| AU | 16597/83 | | 1/1984 |
| AU | 14451/83 | | 11/1984 |
| AU | 32652/84 | | 3/1985 |
| AU | 43262/85 | | 12/1985 |
| AU | 22256/83 | | 1/1986 |
| AU | 38985/85 | | 1/1986 |
| AU | 39567/85 | | 1/1986 |
| AU | 44690/85 | | 1/1986 |
| AU | 56786/86 | | 11/1986 |
| AU | 66137/86 | | 8/1987 |
| AU | 68160/87 | | 8/1987 |
| AU | 67407/87 | | 10/1987 |
| AU | 74092/87 | | 12/1987 |
| AU | 61581/86 | | 2/1988 |
| AU | 21712/88 | | 3/1989 |
| AU | 29156/89 | | 6/1989 |
| AU | 41081/89 | | 3/1990 |
| AU | 58969/90 | | 7/1990 |
| AU | 48910/90 | | 8/1990 |
| AU | 49184/90 | | 8/1990 |
| AU | 50553/90 | | 9/1990 |
| AU | 52154/90 | | 9/1990 |
| AU | 54892/90 | | 9/1990 |
| AU | 60823/90 | | 2/1991 |
| AU | 637706 | | 6/1991 |
| AU | 62542/90 | | 8/1991 |
| AU | 76855/91 | | 10/1991 |
| AU | 75099/91 | | 11/1991 |
| AU | 13960/92 | | 4/1992 |
| AU | 649118 | | 10/1992 |
| AU | 13960/92 | | 10/1992 |
| AU | 28414/92 | | 5/1993 |
| AU | 668197 | | 2/1994 |
| AU | 74544/94 | | 3/1995 |
| AU | AU 677124 | | 5/1995 |
| AU | 683598 | | 4/1996 |
| CA | 716415 | | 8/1965 |
| CA | 955887 | | 10/1974 |
| CH | 407786 | | 2/1966 |
| CH | 587755 | | 3/1977 |
| CH | 0607702 | | 10/1978 |
| DE | 912137 | | 5/1954 |
| DE | 1107541 | | 10/1959 |
| DE | 1807328 | | 11/1967 |
| DE | 1955047 | | 5/1971 |
| DE | 2703404 | | 5/1978 |
| DE | 2704461 | | 8/1978 |
| DE | 3008838 | | 10/1980 |
| EP | 0004500 | A2 | 10/1979 |
| EP | 0055191 | A1 | 6/1982 |
| EP | 109631 | | 11/1983 |
| EP | 2131774 | | 6/1984 |
| EP | 0080846 | A1 | 7/1984 |
| EP | 0146011 | | 11/1984 |
| EP | 136088 | | 4/1985 |
| EP | 269 920 | | 6/1988 |
| EP | 0269920 | A1 | 6/1988 |
| EP | 293901 | | 12/1988 |
| EP | 0299017 | B1 | 4/1990 |
| EP | 0460557 | A2 | 6/1990 |
| EP | 0370272 | A1 | 3/1991 |
| EP | 458 250 | | 11/1991 |
| EP | 460813 | | 12/1991 |
| EP | 0458250 | A2 | 7/1993 |
| EP | 1 216 930 | B1 | 6/2002 |
| ES | ES 2008201 | | 9/1986 |
| FR | 1213812 | | 10/1958 |
| FR | 1270357 | | 10/1960 |
| FR | 1347895 | | 4/1964 |
| FR | 1550358 | | 11/1967 |
| FR | 1536459 | | 8/1968 |
| FR | 1581775 | | 9/1969 |
| FR | 2320870 | | 5/1977 |
| GB | 788148 | | 12/1957 |
| GB | 930866 | | 7/1963 |
| GB | 935574 | | 8/1963 |
| GB | 1024762 | | 4/1966 |
| GB | 1229322 | | 4/1971 |
| GB | 1254930 | | 7/1972 |
| GB | 1309057 | | 3/1973 |
| GB | 1497821 | | 12/1975 |
| GB | 1438648 | | 6/1976 |
| GB | 1499895 | | 2/1978 |
| GB | 1512335 | | 6/1978 |
| GB | 2021530 | | 12/1979 |
| GB | 2063226 | | 6/1981 |
| GB | 1593072 | | 7/1981 |
| GB | 2068914 | | 3/1982 |
| GB | 2076381 | | 3/1982 |
| GB | 2096110 | | 10/1982 |
| GB | 2096114 | | 7/1983 |
| GB | 1602746 | | 11/1983 |
| GB | 2120219 | | 11/1983 |
| GB | 2273493 | | 6/1994 |
| GB | 2311285 | | 9/1997 |
| NL | 169850 | | 4/1982 |
| PL | 8006293 | | 4/1979 |
| PL | RU 37413 | | 12/1981 |
| PL | RU 37844 | | 12/1981 |
| SE | 215091 | | 9/1967 |
| SU | 302888 | | 6/1971 |
| WO | WO 83/00674 | | 3/1983 |
| WO | WO 88/08398 | | 11/1989 |
| WO | WO/020380 | | 9/1994 |
| WO | WO 95/05321 | | 2/1995 |
| WO | WO 96/29257 | * | 9/1996 |

* cited by examiner

CLOSURE WITH EXTENDED SEAL MEMBER

This application is a continuation of application Ser. No. 09/462,781 filed Jun. 15, 2000, U.S. Pat. No. 6,527,132 which is a 371 of PCT/AU98/00510, filed Jul. 3, 1998.

TECHNICAL FIELD

The present invention relates to linerless closures for containers including, but not limited to, carbonated beverage containers. More particularly, the invention relates to such closures that are formed of a synthetic plastics material and, preferably, in one piece.

BACKGROUND ART

U.S. Pat. No. 5,423,444 discloses a plastic closure for a container having an externally screw threaded neck, the closure including a top portion and an internally threaded skirt. The closure has an annular sealing rib which projects downwardly from the underside of the top portion. The rib includes a first, substantially cylindrical portion contiguous with the underside of the top portion and lying adjacent to or abutting with the skirt and a second frusto-conical portion contiguous with the end of the first portion distal to the underside of the top portion and extending radially inwardly to a circular free edge. During threaded attachment of the closure with the neck the second frusto-conical portion will be engaged by a free end of the neck and folded back against the first substantially cylindrical portion of the rib to form a gas tight seal between the neck of the container and the closure.

U.S. Pat. No. 5,609,263 discloses a variant of the above closure in which there is at the free end of the second portion of the rib a thick seal ring of substantially circular cross-sectional shape. The rib and the seal ring are dimensioned to engage the free end of the neck when the closure is threaded onto the neck such that when the neck is fully screwed into the closure its free end crushes the seal ring directly against the inside surface of the top portion of the closure.

The present invention is directed to two arrangements of closure that improve the sealing ability of closures of the type identified in the abovementioned prior art.

DISCLOSURE OF INVENTION

The present invention relates to a closure suitable for mounting onto a container having an opening defined by an end portion of the container, the closure being moulded from a synthetic plastics material and including a top portion and a skirt portion depending from the top portion all annular sealing rib projecting downwardly from an underside of the top portion the rib including a first portion which is contiguous with the top portion and having all inner surface which inner surface lies radially inwardly of the skirt portion, and a second, frusto-conical, portion contiguous with the first portion and separated from the top portion by the inner surface of the first portion, the second portion extending radially inwardly to terminate in a circular edge, the first portion having all internal diameter relative to the external diameter of the end portion of the container such that during attachment of the closure with the end portion of the container, the second frusto-conical portion of the sealing rib will be engaged by a free end of said end portion of the container and folded back at least adjacent the inner surface of the first portion of the rib, the closure being characterised in that the first portion of the rib increases in thickness as it extends away from the top portion of the closure.

In a second aspect, the present invention relates to a closure suitable for mounting onto a container having an opening defined by all end portion of the container, the closure being moulded from a synthetic plastics material and including a top portion and a skirt portion depending from the top portion, an annular sealing rib projecting downwardly from an underside of the top portion, the rib including a first portion which is contiguous with the top portion and having an inner surface, which inner surface lies radially inwardly of the skirt portion, and a second, frusto-conical, portion contiguous with the first portion and separated from the top portion by the inner surface of the first portion, the second portion extending radially inwardly to terminate in a circular edge, the closure being characterised in that the sealing rib has a third portion connected to the second portion at or adjacent the circular edge and extending generally in a direction away from the top portion, the third portion being substantially no thicker than the second portion and having a length longer than its thickness, the first portion having an internal diameter relative to the external diameter of the end portion of the container such that during attachment of the closure with the end portion of the container, the second frusto-conical portion of the sealing rib will be engaged by a free end of said end portion of the container and folded back at least adjacent the inner surface of the first portion of the rib, and with the third portion of the rib positioned between the neck of the container and the top portion of the closure.

The closures are preferably provided with a screw thread oil the inside surface of the skirt portion adapted to engage with a corresponding thread oil ail external surface of the end portion of the container. It is, however, possible for the container and the closure to be formed with other complementary attachment means. Such all arrangement could, for instance, comprise snap-on attachment means having a rib on the inside surface of the closure and a corresponding groove on the outside surface of the end portion of the container.

The first portion of the rib is preferably formed radially inwardly of the skirt with an annular space therebetween, it is, however, possible in other embodiments to form the first portion of the rib in abutment with the skirt in the sense that the are continuous. In one embodiment of the above aspects of the invention, the first portion of the rib is observed as a thickening of the skirt portion so that the root of the second portion of the rib is moved inwardly of the part of the skirt portion carrying the screw thread or other attachment means.

In each aspect, the first portion serves to form an abutment towards which the second portion is folded during attachment of the closure with the end portion of a container. Preferably, the second portion will be folded back against the first portion such that it bears against the inner surface of the first portion. This will cause the second portion to bear more strongly against the outside surface of the end portion of the container and so form a better seal with the end portion.

The first aspect of the present invention is directed to the first portion of the rib having a thickness that increases in a direction away from the top portion of the closure. This thickening of the first portion will increase the force of the pressure of the rib against the outside surface of the end portion of the closure. The thickness of the first portion preferably increases at a uniform rate along the length of the first portion however it could do so in a non-uniform manner. The increase in the thickness of the first portion means that the inside and outside surfaces of the first portion will not necessarily be exactly cylindrical. They may respectively taper slightly inwardly and outwardly relative to the axis of the closure in a direction away from the top portion of the closure.

In the second aspect of the present invention, the rib includes a third portion. This third portion is preferably contiguous with the free edge of the second portion, though it may be spaced slightly radially outwardly from it. The third portion projects generally away from the top of the closure. It may join the second portion in an angular disjunction or it may join it in a smooth angular transition from the generally radially inward direction of the second portion to a generally axial direction.

It is of the essence of this second aspect of the present invention that the third portion of the rib be substantially no thicker than the second portion and also be relatively longer in relation to its thickness. It has been found that the sealing qualities of the closure are best improved by providing a thin extension to the second portion of the rib that will wrap around the free end of the end portion of the container from a position on a cylindrical outer surface of the end portion at least to the apex of the free end of the end portion. It has also been found that this construction also reduces the torque needed to unscrew a closure from a corresponding container to which it has been attached.

The closures according to the present invention may be made of any suitable synthetic plastics material, however it is preferred to form them from a suitable grade of polyethylene or polypropylene. It is also preferred to form the closure in one piece by injection or rotary mouldinig. The closures could, however, be formed in two parts with the sealing rib formed separately from the top portion and the skirt portion.

It will be apparent to persons skilled in the art that numerous modifications may be made to the closures described in this specification without departing from the scope of the invention as earlier defined. The closure may, for instance, be provided with a tamper evident band, for example a band such as is described in Australian patent specifications 668197 and 683598, the contents whereof are incorporated herein by reference.

Where the closure has a screw thread on the inner surface of the skirt, the thread can be continuous or formed of a series of thread segments. If formed from a series of thread segments, the thread segments can be arranged, starting from a first thread segment distal to the top, along a helical thread locus, as is described in Australian patent specification 668197. Each of the thread segments except the first can be formed with two substantially planar end surfaces that are inclined to the axis of the closure and face away from the top of the closure, that is they face in the direction that a mould core used to mould the closure was withdrawn. In this specification, the term "substanitially planar surface" is used to describe a surface that is nearly actually planar or that is curved provided that it all faces in the defined direction. The first of the thread segments is preferably pointed at its end distal to its one adjacent thread segment to assist in mating the thread on the closure with a complementary thread on the neck of a container.

The substantially planar ends of the thread segments call also be inclined to a notional radial plane of the closure extending from the longitudinal axis of the closure to the end of the respective thread segment such that the ends are inclined to the cylindrical skirt by an angle that is less than the angle that the respective notional plane makes with that skirt.

To assist in the venting of gas that may be present in the container, the spaces between the thread segments in adjacent turns of the thread call be aligned. A groove may also be provided oil the inside surface of the skirt of the closure extending longitudinally thereof through the aligned spaces.

There also call be at the line of meeting of the first and second portions of the sealing rib, a weakened zone or annular region of weakness to assist even deformation of the second portion relative to the first as the closure is applied to a container as is described in Australian patent specification 637706, the contents whereof are incorporated herein by reference.

The underside of the top portion of the closure call also have a continuous or segmented annular ridge radially inside of the sealing rib. The upper surface of the second portion of the rib may also be formed with an engagement means comprising a segmented or continuous annular ridge as is described in Australian patent specification 74544/94, the contents whereof are incorporated herein by reference. On attachment of the closure with the neck of a container, the engagement means engage with the underside of the top portion.

In accordance with the above, the closure can have a tamper evident band adapted to provide all indication of removal or attempted removal of the closure from a container. The tamper evident band can extend from the skirt portion by connection through a plurality of frangible bridges.

The band call also comprise a generally cylindrical body portion and a segmented rib extending inwardly of the body portion and adapted to provide a lip having all inner free edge to engage under a retaining flange extending outwardly from the end portion of the container, characterised in that the combined length of the segmented ribs is equal to at least 50% of the internal circumference of the band and the segmented ribs are separated from each other by a gap, the rib segments each having an upper surface facing generally towards the top portion of the closure and an underside facing generally away from the top portion, the inner surface of the band having a plurality of radially inward projections extending from above the free edge of the band and not extending beyond the inner free edge of the lip.

The band can also comprise a generally cylindrical body portion and a segmented rib extending inwardly of the body portion and adapted to provide a lip having an inner free edge to engage under a retaining flange extending outwardly from the end portion of the container, the rib segments each having an upper surface facing generally towards the top portion of the closure and an underside facing generally away from the top portion, characterised in that the upper surface of each rib comprises a first surface contiguous with the body portion of the band, which surface slopes inwardly and downwardly away from the top portion, and a second surface which extends radially inwardly from the inner terminus of the first surface and has a slope angle substantially normal to the skirt portion of the closure.

BRIEF DESCRIPTION OF DRAWINGS

The following description of a preferred embodiment of the present invention is provided as an example of the invention and is described with reference to the accompanying drawings, in which.

BEST MODE FOR CARRYING OUT THE INVENTION

Figure 1:
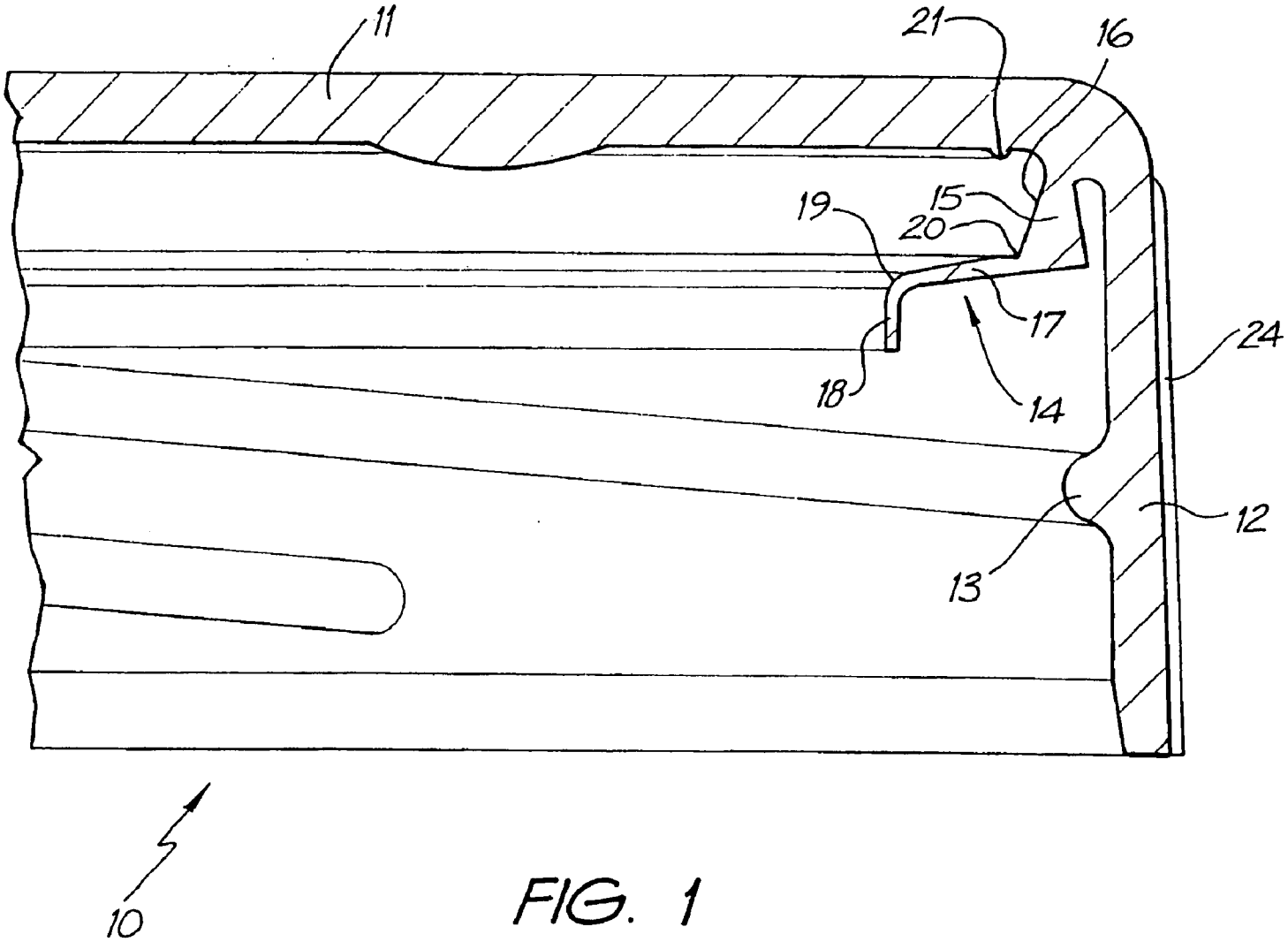
FIG. 1 is a diametrical sectional view through a part of a closure according to the first and the second aspects of the present invention.

The closure 10 shown in FIG. 1 comprises a circular top 11 and a depending skirt 12. The radially inner surface of the skirt 12 is provided with a non-segmented screw thread 13 adapted to mate with a corresponding thread on the neck of a bottle to which the closure 10 is adapted to be attached. While the embodiments of the closure depicted in FIGS. 1 to 4 are depicted with non-segmented screw threads, other suitable means for attaching the closure to the container would be immediately apparent to a person skilled in the art. The segmented screw thread on the embodiment of the closure depicted in FIG. 5 can also readily be envisaged as being used, if required, on the embodiments of the closure depicted in FIGS. 1–4. The radially outer surface of the skirt 12 carries a series of fine vertical ribs 24. The fine ribs 24 can terminate at the lower edge of the skirt 12 in a narrow circumferential rib 25 as, for example, depicted on the closure of FIG. 5.

A sealing rib 14 is provided on the underside of the top 11 of the closure 10. The rib 14 is continuous and annular. Seen in cross-section the rib 14 has three portions 15, 17 and 18. The first portion 15 is contiguous with the top 11 and is substantially cylindrical in shape. The thickness of the first portion 15 increases as the first portion 15 progresses away from the top 11. The inside surface 16 of the first portion is thus not exactly cylindrical, at least until the closure has been applied to the neck of a bottle. The second portion 17 of the rib 14 is frusto-conical in form and tapers slightly in thickness as it extends radially inwardly from its outer edge which is contiguous with the lower end of the first portion 15. A sharp edge 20 is formed between the first portion 15 and the second portion 17. This sharp edge 20 defines a line of weakness between the two parts for a purpose that will be described later in this specification. The third portion 18 is contiguous with the radially inner end of the second portion 17, the two joining in a curved transition zone 19. The transition zone 19 changes the direction of the third portion 18 so that it projects substantially in an axial direction away from the top 11.

A short downwardly extending ridge 21 is also provided on the underside of the top 11 radially inside the rib 14.

Figure 2:
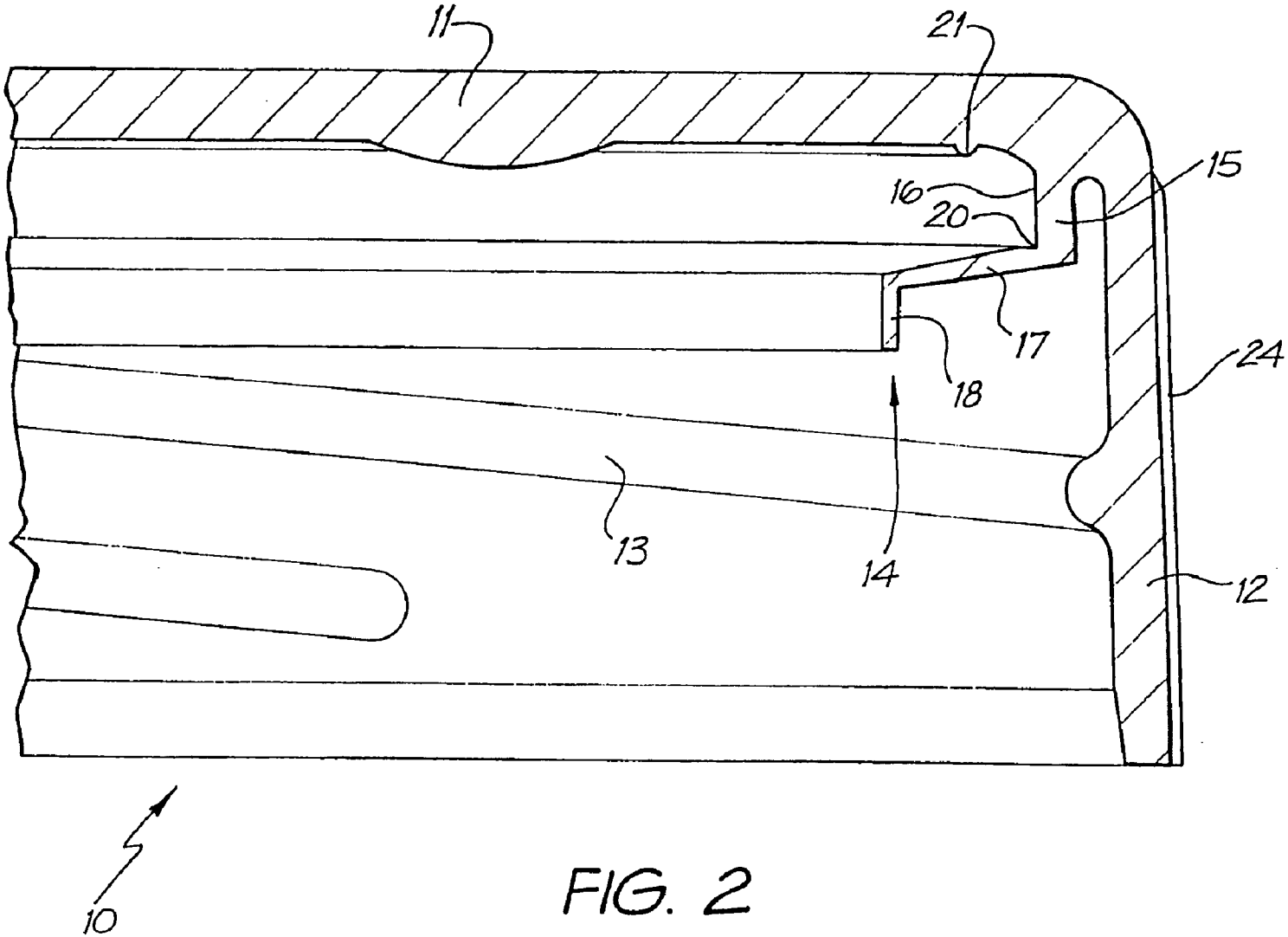
FIG. 2 is a diametrical sectional view through a part of another embodiment of a closure according to the second aspect of the present invention.
Figure 3:
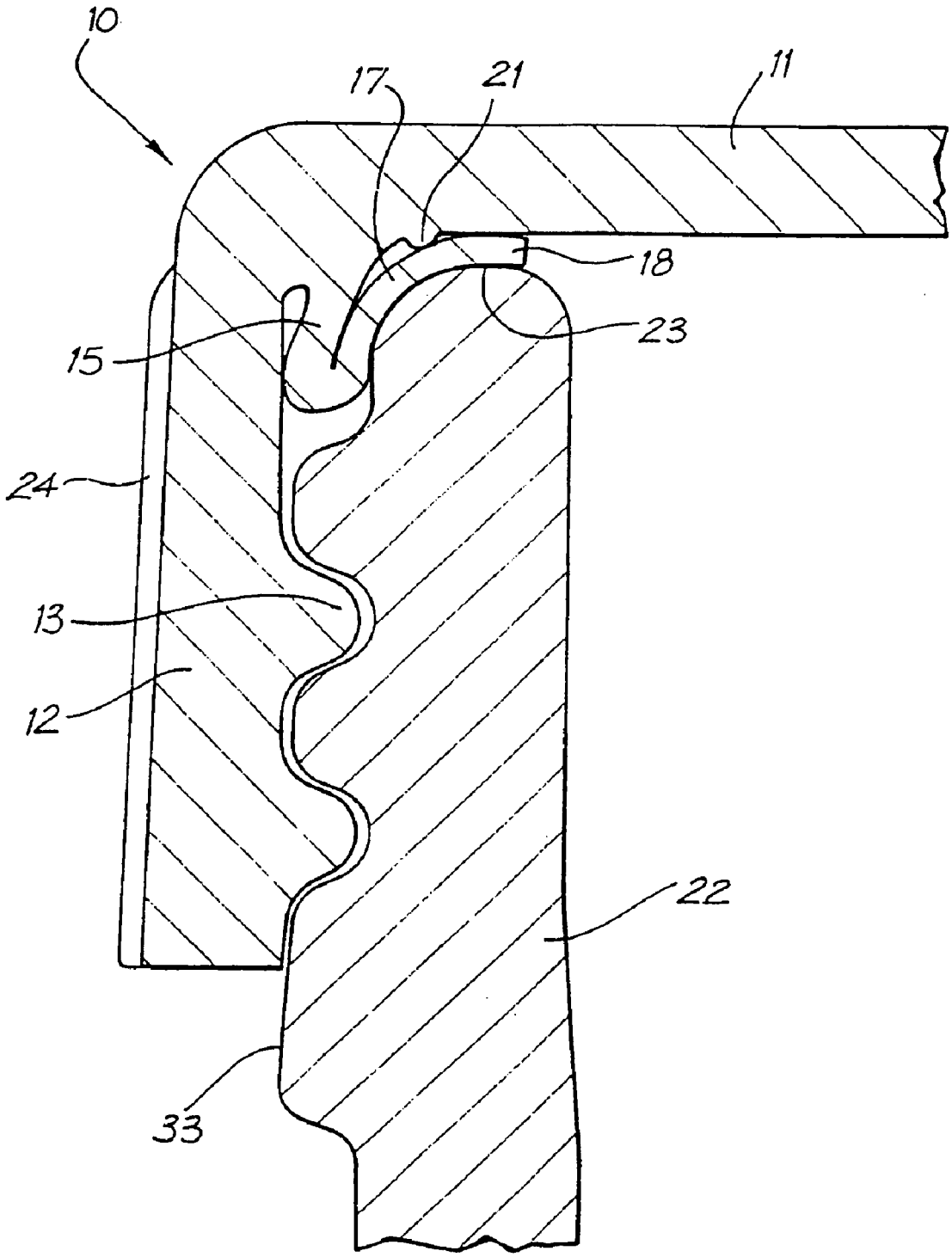
FIG. 3 is a diametrical sectional view of a part of the closure of FIG. 2 when applied to the end portion of a container.

The arrangement shown in FIGS. 2 and 3 is essentially similar to that described in FIG. 1 with the exception that the first portion 15 of the rib 14 is of constant thickness along its length and the second portion 17 and the third portion 18 join in a sharp angular disjunction rather than the smoothly curved transition zone 19 seen in FIG. 1. As is seen in FIG. 3 when the closure 10 is applied to the neck 22 of a bottle, a free end 23 of the neck 22 engages the radially outer side of the third portion 18 and starts to push it towards the inside surface of the top 11. The second portion 17 is also pushed upwardly towards the top 11. As the second portion 17 is pushed upwardly it bends relative to the first portion 15 along the line of weakness defined by the sharp edge 20. This ensures that the folding back of the second portion 17 relative to the first portion 15 takes place evenly around the whole circumference of the rib 14. The folding back of the second portion 17, and with it the third portion 18, continues until the third portion 18 is trapped between the free end 23 of the neck 22 and the inside surface of the top 11. When this happens the second portion 15 will normally be folded back adjacent to or in contact with the inside surface 16 of the first portion 15. In the embodiment depicted in FIG. 3, the first portion 15 is pushed radially outwardly and bears against the radially inner surface of the skirt 12. A seal will then be formed between the closure 10 and the neck 22 extending from a radially outer portion of the neck 22 around to the apex of the free end 23. While the, arrangement shown in FIG. 3 has the first portion 15 of constant thickness it will be appreciated that if the first portion 15 were to taper outwardly in thickness towards its lower end (as is shown in FIG. 1) then this would have the effect of causing the first portion 15 to bear against the inside surface of the skirt 12 sooner and thus to apply more pressure to the radially outer surface of the neck 22 and thus further improve the seal between the closure 10 and the neck 22.

Figure 2A:
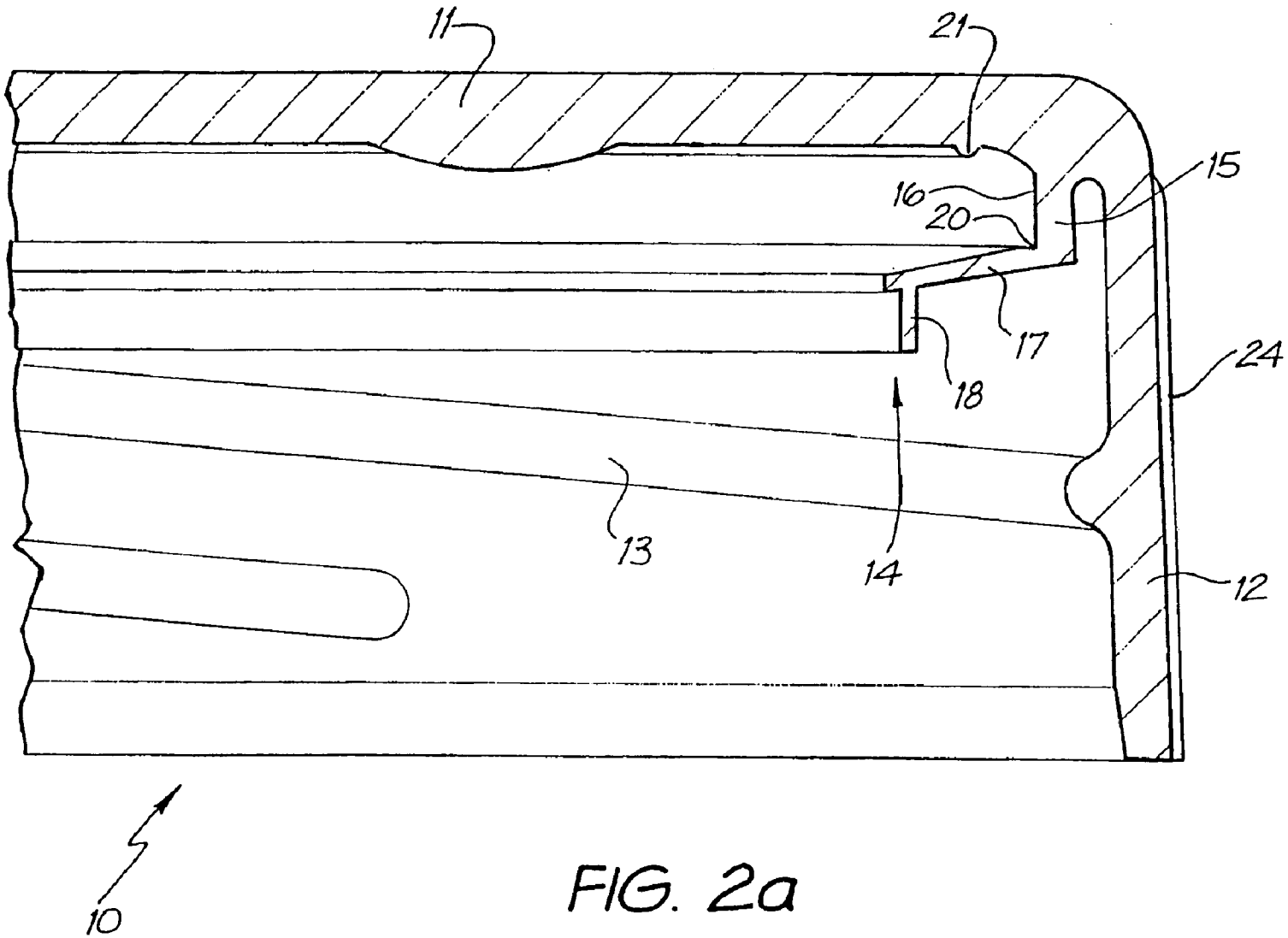
FIG. 2*a* is a diametrical sectional view through a part of another embodiment of a closure according to the second aspect of the present invention.

While the third portion 18 is contiguous with the radial inner end of the second portion 17 in FIG. 2, an alternative embodiment is depicted in FIG. 2*a* in which the third portion 18 extends downwardly from the second portion 17 adjacent its inner end. While the third portion 18 is in a slightly different position, the manner in which the second portion 17 of the sealing rib 14 will fold back towards the inner surface 16 of the first portion 15 is substantially identical to that depicted in FIG. 3.

Figure 4:
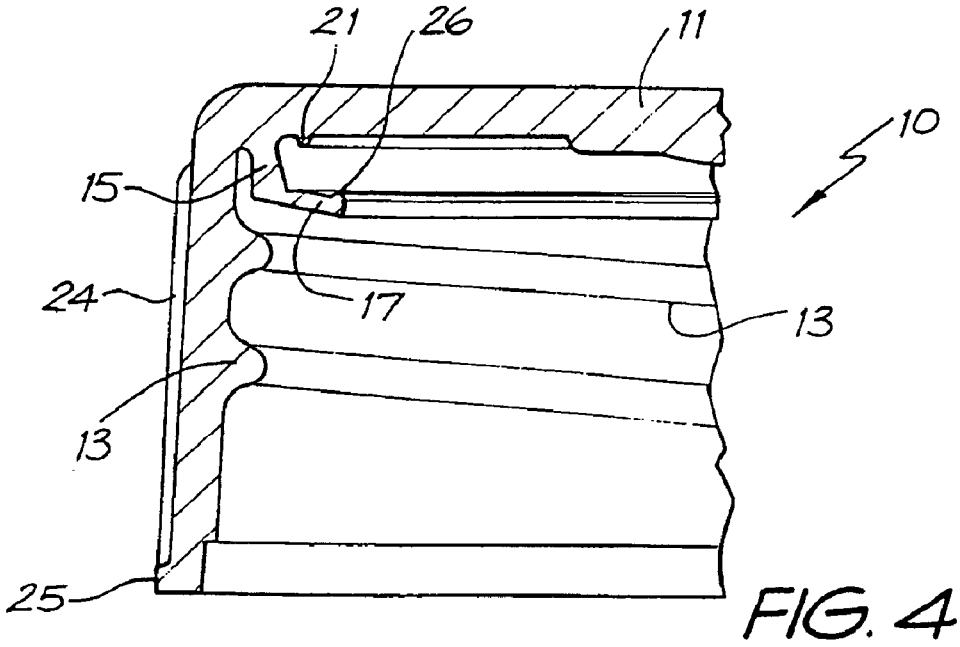
FIG. 4 is a vertical sectional view through a part of an embodiment of a closure according to the first aspect of the present invention.
Figure 5:
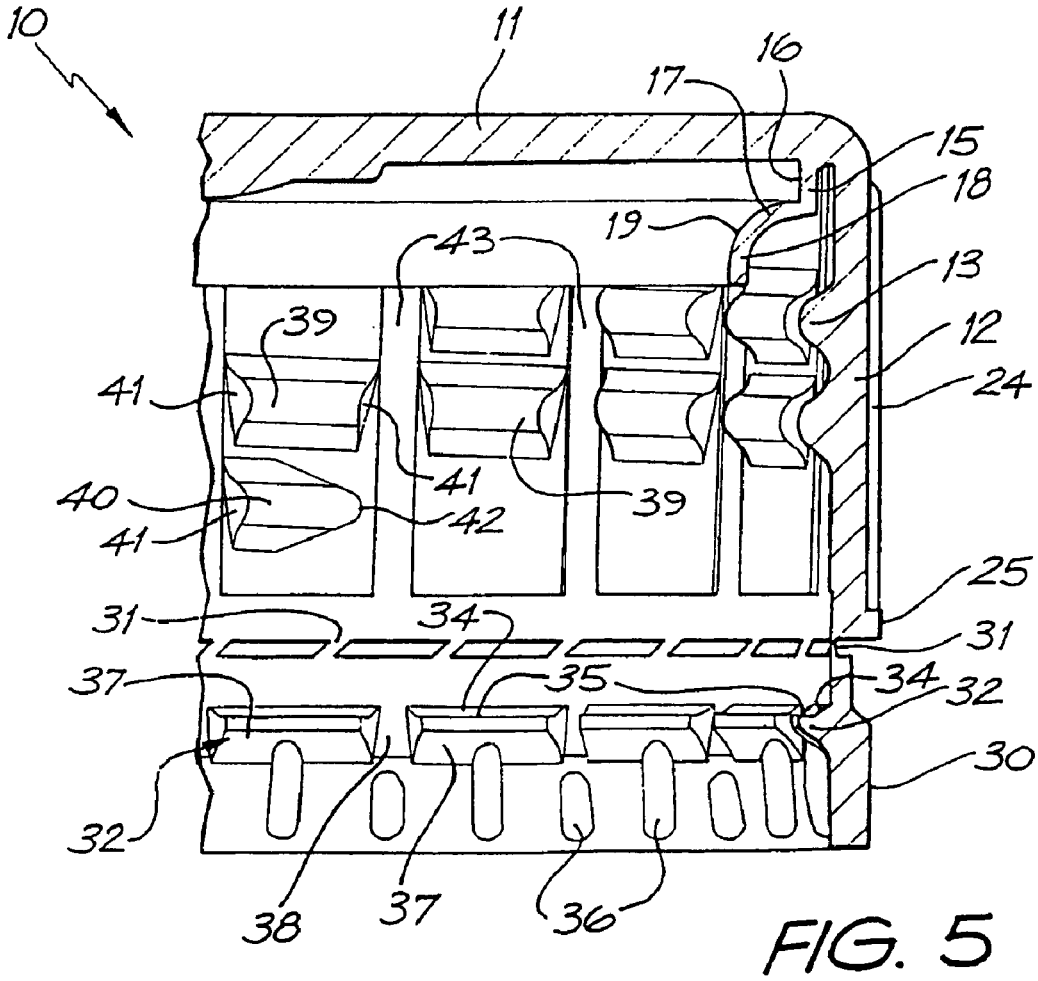
FIG. 5 is a vertical sectional view through a part of another embodiment of a closure according to the second aspect of the present invention.

FIGS. 4 and 5 show respectively a part of a closure according to the first aspect of the present invention and a part of a closure according to the second aspect of the invention. In the case of FIG. 4 the closure 10 has a first portion 15 which increases in thickness away from the top 11 but without a third portion 18. In FIG. 5 the closure 10 has a rib 14 in which there is a transition zone 19 between the second portion 17 and the third portion 18 that is of relatively large radius.

In FIG. 4, the closure also has a short downwardly extending ridge 21 provided on the underside of the top 11 radially inside the rib 14. On the upper surface of the second portion 17 of the sealing rib 14 and adjacent its inner end, there is also provided a continuous annular ridge 26. When the closure 10 is attached to the neck 22 of a container and the second portion 17 is folded back towards the first portion 15, the annular ridge 26 engages with the underside of the top portion 11. In some cases, the annular ridge 26 call also interlock with the downwardly extending ridge 21 provided on the underside of the top 11 of the closure 10. While ridges 21, 26 are each depicted as continuous, the ridges can be readily envisaged as being comprised of a plurality of segments separated by short gaps.

As depicted in FIG. 5, the closure 10 includes a band 30 attached by frangible bridges 31 to the lower edge of the skirt 12. The band 30 includes a rib 32 about its inside surface being sized and shaped so as to provide an inwardly extending lip which will engage under the retaining flange 33 (see FIG. 3) of the neck 22 of the container once the closure 10 is fully closed onto the neck 22.

The rib 32 is made up of a series of rib segments 37 separated by short breaks 38 and in the depicted embodiment constitutes about 85% of the circumference of the band 30. The short breaks 38 provide circumferential flexibility to the band 30 and allow the rib 32 to pass over the retaining flange 33 without creating a stress sufficient to break the frangible bridges 31.

The rib 32 has an upper side directed towards the top 11 of the closure 10 and all under side directed away from it. The upper side includes a radially outer frusto-conical surface 34 and a radially inner annular surface 35. The annular surface 35 lies in a plane normal to a longitudinal axis of the closure 10 while the frusto-conical surface 34 is inclined inwardly and downwardly away from the top portion 11 and makes an angle of about 20° with the plane normal to the longitudinal axis of the closure. The presence of the frusto-conical surface 34 assists in the moulding of the closure 10 as it prevents or at least substantially reduces the production of closures having deformed ribs 32.

Below the rib 32 and still on the inside surface of the band 30 is an arrangement of a plurality of inward extending projections 36 each having a long axis generally aligned with the longitudinal axis of the closure 10. The projections 36 serve to help prevent a person from introducing a device such as a knife blade radially inwardly of the body portion 12 of the band 30 and progressively moving the device circumferenitially around the band in an effort to gradually prise the rib 32 up and over the flange 33 on the container.

In FIG. 5, the thread 13 is made up of a plurality of thread segments 39 arranged in spaced apart array along the locus of the thread. Each thread segment, except the first segment 40, is bounded at each end by a planar surface 41. Each of the planar surfaces 41 are inclined to the longitudinal axis of the closure 10 so that it faces away from the top 11. Each planar surface 41 is also inclined relative to a notional radial plane extending from the axis of the closure 10 to the planar surface 41 in question such that the minimum included angle between the planar surface 41 and the skirt 12 is acute and is less than the angle that a notional radial plane makes with the skirt 12.

The first thread segment 40 is formed with a planar surface 41 on its trailing edge, however, it is formed with a point 42 on its leading edge to assist in mating the thread with a corresponding thread on the neck 22 of a container.

The thread segments 39 in each turn of the thread are aligned as are the spaces between them. A groove 43 is formed on the inside surface of the skirt 12 in each of the aligned spaces between adjacent thread segments 39. The grooves 43 serve to assist in venting any gas that may be present in the container and, in particular, gases from carbonated beverages as the closure 10 is unscrewed from the container.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A closure suitable for mounting onto a container having an opening defined by an end portion of the container, said end portion having an outer surface, an inner surface and a free end, the closure including:

a top portion;

a skirt portion depending from the top portion; and an annular sealing rib projecting downwardly from an underside of the top portion, the rib including:

a first portion which is contiguous with the top portion and has an inner surface, which inner surface lies radially inwardly of the skirt portion;

a second, frusto-conical, portion contiguous with the first portion and separated from the top portion by the inner surface of the first portion, the second portion having an upper surface and a lower surface and extending radially inwardly to terminate in a circular edge; and a third portion, having an inner surface and an outer surface, and connected to the second portion at or adjacent the circular edge, the third portion, prior to mounting of the closure to said end portion, extends generally in a direction away from the top portion with the outer surface disposed at an angle to the lower surface of the second portion, and being substantially no thicker than the second portion, and having a length longer than its thickness;

wherein the first portion has an internal diameter relative to the external diameter of the end portion of the container such that during attachment of the closure with the end portion of the container, the second frusto-conical portion of the sealing rib will be engaged by said end portion of the container with the upper surface of the second portion folded back towards and at least adjacent the inner surface of the first portion of the rib;

and further wherein said length of the third portion is such that on attachment said third portion is positioned between the end portion of the container and the top portion of the closure and wraps around the free end of the end portion from a first position on the outer surface of the end portion to at least the apex of the free end.

2. The closure of claim 1 wherein the third portion is contiguous with the free edge of the second portion.

3. The closure of claim 1 wherein the third portion joins the second portion in an angular disjunction.

4. The closure of claim 1 wherein the third portion joins the second portion in a smooth angular transition from the generally radially inward direction of the second portion to a generally axial direction.

5. The closure of claim 1 wherein the skirt portion has an inner surface having a screw thread adapted to engage with a corresponding thread on the external surface of the end portion of the container.

6. The closure of claim 1 wherein the skirt portion has an inner surface having a rib adapted to engage with a corresponding groove on the external surface of the end portion of the container.

7. The closure of claim 1 wherein the first portion of the rib is formed radially inwardly of the skirt portion with an annular space therebetween.

8. The closure of claim 1 wherein the first portion of the rib is in continuous abutment with the skirt portion.

9. The closure of claim 8 wherein the first portion of the rib comprises a thickening of the skirt portion adjacent the top portion.

10. The closure of claim 1 wherein the first portion serves to form an abutment towards which the second portion is folded during attachment of the closure with the neck of a container.

11. The closure of claim 1 wherein during attachment of the closure with the neck of the container, the second portion is folded back against the first portion so that it bears against the inner surface of the first portion.

12. The closure of claim 1 wherein the closure is made from polyethylene.

13. The closure of claim 1 wherein the closure is formed in one piece.

14. The closure of claim 1 wherein the closure has a tamper evident band adapted to provide an indication of removal or attempted removal of the closure from a container.

15. The closure of claim 14 wherein the tamper evident band extends from the skirt portion by connection through a plurality of frangible bridges.

16. The closure of claim 15 wherein the band comprises a generally cylindrical body portion and a segmented rib extending inwardly of the body portion and adapted to provide a lip having an inner free edge to engage under a retaining flange extending outwardly from the end portion of the container, characterised in that the combined length of the segmented ribs is equal to at least 50% of the internal circumference of the band and the segmented ribs are separated from each other by a gap, the rib segments each having an upper surface facing generally towards the top portion of the closure and an underside facing generally away from the top portion, the inner surface of the band having a plurality of radially inward projections extending from above the free edge of the band and not extending beyond the inner free edge of the lip.

17. The closure of claim 15 wherein the band comprises a generally cylindrical body portion and a segmented rib extending inwardly of the body portion and adapted to provide a lip having an inner free edge to engage under a retaining flange extending outwardly from the end portion of the container, the rib segments each having an upper surface facing generally towards the top portion of the closure and an underside facing generally away from the top portion, characterised in that the upper surface of each rib comprises a first surface contiguous with the body portion of the band, which surface slopes inwardly and downwardly away from the top portion, and a second surface which extends radially inwardly from the inner terminus of the first surface and has a slope angle substantially normal to the skirt portion of the closure.

18. The closure of claim 16 and further wherein the rib segments each have an upper surface facing generally towards the top portion of the closure and an underside facing generally away from the top portion, characterised in that the upper surface of each rib comprises a first surface contiguous with the body portion of the band, which surface slopes inwardly and downwardly away from the top portion, and a second surface which extends radially inwardly from the inner terminus of the first surface and has a slope angle substantially normal to the skirt portion of the closure.

19. The closure of claim 1 wherein the sealing rib includes a substantially annular region of weakness formed around an inside surface of the sealing rib approximately at the join between the first and second portions of the sealing rib.

20. The closure of claim 1 wherein the underside of the top portion of the closure is provided with a segmented annular ridge positioned inwardly and adjacent the first portion of the sealing rib.

21. The closure of claim 1 wherein the underside of the top portion of the closure is provided with a continuous annular ridge positioned inwardly and adjacent the first portion of the sealing rib.

22. The closure of claim 1 wherein the first portion of the rib increases in thickness as it extends away from the top portion of the closure.

23. The closure of claim 22 wherein the thickness of the first portion increases at a uniform rate along the length of the first portion away from the underside of the top portion.

* * * * *